US011154760B2

(12) United States Patent
Mealing et al.

(10) Patent No.: US 11,154,760 B2
(45) Date of Patent: Oct. 26, 2021

(54) MODULAR CRACK CLIMBING SYSTEMS

(71) Applicant: Jam Walls, LLC, Heber City, UT (US)

(72) Inventors: Donald R. Mealing, Heber City, UT (US); Dale R. Bard, Heber City, UT (US); David B. Yerian, Berkeley, CA (US)

(73) Assignee: Jam Walls, LLC, Heber City, UT (US)

( * ) Notice: Subject to any disclaimer, the term of this patent is extended or adjusted under 35 U.S.C. 154(b) by 0 days.

(21) Appl. No.: 16/408,275

(22) Filed: May 9, 2019

(65) Prior Publication Data

US 2020/0353339 A1 Nov. 12, 2020

(51) Int. Cl.

| | |
|---|---|
| ***A63B 69/00*** | (2006.01) |
| ***A63B 17/04*** | (2006.01) |
| ***A63B 9/00*** | (2006.01) |

(52) U.S. Cl.

CPC ..... *A63B 69/0048* (2013.01); *A63B 17/04* (2013.01); *A63B 9/00* (2013.01)

(58) Field of Classification Search

CPC ..... A63B 69/0048; A63B 17/04; A63B 9/00
See application file for complete search history.

(56) References Cited

U.S. PATENT DOCUMENTS 5,092,587 A * 3/1992 Ulner ..... A63B 69/0048 248/925
5,543,185 A * 8/1996 Christensen ..... A63B 69/0048 156/61
6,514,178 B2 * 2/2003 Vettori ..... A63B 69/0048 482/37
9,573,011 B1 * 2/2017 Nasta ..... A63B 21/00
10,058,757 B2 * 8/2018 McGowan ..... A63B 27/00

(Continued)

FOREIGN PATENT DOCUMENTS

| | | |
|---|---|---|
| FR | 2570951 A1 | 4/1986 |
| GB | 2343124 A | 5/2000 |
| WO | 2010132865 A1 | 11/2010 |

OTHER PUBLICATIONS

Crack Climbing Tips: Finger Jams With Tom Randall | Climbing Daily Ep.1105 "https://www.youtube.com/watch?v=ESZjWZPx2Kk" Feb. 8, 2018 (Year: 2018).*

(Continued)

*Primary Examiner* — Nyca T Nguyen
(74) *Attorney, Agent, or Firm* — Dentons Durham Jones Pinegar

(57) ABSTRACT

A pod that enables crack climbing on climbing surfaces of manufactured climbing structures includes a body and face. The body may include two sides with adjacent side walls having opposed interior surfaces that define a crack, which extends to the face of the pod. The crack may resemble a crack in a natural rock climbing formation or even simulate a crack of a natural rock climbing formation. The pod may be part of a crack climbing module that also includes a frame that can be mounted to a climbing surface of a conventional manufactured climbing wall to enable crack climbing on such a wall. The pod may also be used with manufactured climbing structures (e.g., climbing walls, climbing towers, artificial boulders, etc.) that include pod-receiving channels. Pods with cracks of different shapes may interchanged to provide varied crack climbing experiences.

11 Claims, 6 Drawing Sheets

(56) References Cited

U.S. PATENT DOCUMENTS

| | | | | |
|---|---|---|---|---|
| 10,646,751 | B2 * | 5/2020 | Bennett | A63B 29/024 |
| 2002/0046903 | A1 * | 4/2002 | Strickler | A62B 35/0093 182/36 |
| 2005/0164834 | A1 * | 7/2005 | Paulete | A63B 69/0048 482/37 |
| 2006/0116244 | A1 | 6/2006 | Postma et al. | |
| 2006/0192066 | A1 * | 8/2006 | Mills | A63B 69/0048 248/314 |
| 2013/0240698 | A1 * | 9/2013 | Diwan | A47B 81/005 248/231.91 |
| 2015/0056590 | A1 * | 2/2015 | Brost | A63B 69/0048 434/247 |
| 2017/0296877 | A1 | 10/2017 | Bennett | |
| 2019/0032335 | A1 * | 1/2019 | Sudeith | E04B 2/56 |
| 2020/0094102 | A1 * | 3/2020 | McRann | A63B 23/1218 |

OTHER PUBLICATIONS

From Fingers To Fists "https://www.climbingbusinessjournal.com/from-fingers-to-fists/" Dec. 3, 2015 (Year: 2015).*

European Patent Office, "Extended European Search Report," European application No. EP19173903.6, dated Nov. 12, 2019.

USPTO as International Searching Authority, "International Search Report and Written Opinion," International Application No. PCT/US2020/032387, dated Jul. 9, 2020.

* cited by examiner

MODULAR CRACK CLIMBING SYSTEMS

TECHNICAL FIELD

This disclosure relates generally to manufactured rock climbing walls and to components of manufactured rock climbing walls. More specifically, this disclosure relates to components of manufactured rock climbing walls that enable individuals to practice climbing cracks, or "crack climbing." Even more specifically, this disclosure relates to modular cracks that are capable of being removably mounted to manufactured rock climbing walls.

RELATED ART

Manufactured rock climbing walls, which are also commonly referred to as "indoor climbing walls," enable individuals to learn and improve their rock climbing skills. Indoor climbing walls can be found in specialty rock climbing gyms, at stores that sell rock climbing equipment, and in individuals' homes. It is generally much safer for individuals to learn and improve climbing skills on an indoor climbing wall in a controlled environment than on a natural rock wall in nature. Although many indoor climbing walls are tall, their heights are typically much shorter than the rock faces that an individual will climb in nature. The horizontal surfaces (e.g., the floor, etc.) below indoor climbing walls are often padded, providing individuals with additional protection if they fall while learning and/or improving their rock climbing skills. Indoor climbing walls provide the additional advantage of belay protection, where the climber is secured by a rope running through a belay bar at the top of the climbing surface and then back down to the individual climbing the climbing surface. The belay rope is typically held by an individual who acts as a climbing partner to the individual ascending the climbing surface. Individuals who climb in gyms may also use an auto-belay cable system that will safely lower the individual to the floor if he or she loses his or her grip on the wall and falls. Gym climbers can allow peers and instructors to observe their technique and procedure more closely than they could in nature, enabling peers and instructors to provide advice or instructions as the individual encounters new challenges.

An indoor climbing wall typically includes a support frame, a climbing surface mounted to the support frame, a plurality of t-nuts arranged across the climbing surface, and holds mounted to the t-nuts and, thus, to the climbing surface. The support frame may comprise the frame of a wall of a building or any other structure that will support the weight of the climbing surface and one or more climbers as they grasp holds that have been secured to the climbing surface. Climbing surfaces may be oriented vertically and/or at one or more angles that overhang a horizontal surface (e.g., a floor, etc.) above which the indoor climbing wall extends. The t-nuts, which are typically recessed within a climbing surface, may be arranged across the climbing surface in an array or randomly. Bolts that complementarily engage the t-nuts may couple holds of various shapes and sizes to the t-nuts and, thus, secure the holds to the wall. The bolts that are typically used to secure holds to the t-nuts in the climbing surface of a climbing wall (i.e., "standard climbing hold bolts") are typically ⅜-16 socket cap bolts (i.e., bolts with a diameter of % inch over the largest parts of their threads, a pitch of 16 threads, or thread turns, per inch, and a cylindrical head with a socket that will receive a so-called Allen wrench or hex wrench). The arrangement of the t-nuts, the spacing between t-nuts, and the availability of a variety of different holds may facilitate the placement and orientation of holds on the climbing surface in a wide variety of arrangements, enabling individuals to establish a variety of routes of various difficulties up the indoor climbing wall.

While conventional indoor climbing walls let individuals develop their skills in identifying and climbing routes that include features that protrude from the face of the wall, the opportunities they provide for learning to use cavities, or hollows, and cracks while climbing are typically very limited. Commercial indoor rock climbing gyms have rarely installed crack climbs because they require specialized construction techniques and extensive wall space. When cracks are present in conventional indoor climbing walls, they are often limited to straight-in cracks of constant width or molded permanent cracks that provide little variation and, thus, little opportunity for the types of crack climbing experiences that will be valuable in nature. Climbers may also grow tired of repeatedly climbing the same crack. Such permanently fixed cracks are expensive to modify or replace when climbers grow tired of trying to climb the same crack over and over. Thus, the availability of opportunities to practice crack climbing in the controlled, relatively safe environments where indoor climbing walls are typically present has historically been very limited.

SUMMARY

A crack climbing module according to this disclosure may be mounted to a climbing surface of a conventional manufactured rock climbing wall. For the sake of simplicity, a manufactured rock climbing wall may also be referred to herein as a "climbing wall." A crack climbing module that may be secured to a climbing surface of a climbing wall may include a crack that resembles a crack in a natural rock face. More specifically, the crack of a crack climbing module according to this disclosure may provide a continuous crack with variations, or irregularities, that resemble the variations that may be found in cracks in natural rock faces, which may also be referred to as "natural cracks." Such variations may include the shapes of natural cracks (e.g., linear, jagged, etc.), the textures of natural cracks (e.g., rough, smooth, sharp corners, smooth corners, etc.), the widths of natural cracks, and the like, as well as any combination of the foregoing.

In various embodiments, a crack climbing module may include a frame and a pod, which together may be referred to as a panel. A configuration of the frame may enable it to be secured to a climbing surface of a climbing wall. The frame may removably hold the pod, which defines the crack, including its width and shape.

The frame may have a configuration that enables it to be mounted to the climbing surface of a conventional indoor climbing wall. More specifically, a base of the frame may have a configuration that enables the frame to be mounted to a climbing wall. The frame may be mounted to a climbing surface of a climbing wall in a manner that will hold the weight of at least one individual as he or she climbs the climbing surface of a climbing wall to which the frame has been mounted. In addition, the frame may be able to withstand forces exerted thereon as an individual who is climbing the climbing surface uses his or her fingers and hands to jam inside the pod's crack. Maintaining proper jamming strength is how a climber moves up a wall surface. In some embodiments, the base of the frame may include apertures that can align with t-nuts in the climbing surface and receive bolts that will engage the t-nuts (e.g., standard climbing hold bolts, etc.) and be engaged by the heads of such bolts.

The frame may include side walls that protrude outwardly from the base to define an elongated receptacle, or channel, capable of receiving, engaging, and selectively releasing one or more pods. The side walls of the frame may have inner surfaces that oppose, or face, one another. The inner surfaces of the side walls may be relatively planar and oriented parallel to one another. Such a configuration may enable the receptacle to receive the bodies of pods that are rectangular in shape. The distance each side wall extends from the base, or its height, may define a depth of the receptacle. The receptacle may have a depth that can accommodate a pod that includes a crack with a depth that will provide an individual with an experience that approximates crack climbing in nature.

A coupling deck may project outwardly from each side wall of the frame, with the coupling decks on opposed side walls extending in opposite directions from one another. The coupling decks may include coupling elements that enable a pod that has been introduced into the receptacle to be coupled to the frame. As an example, each of the coupling decks may include a plurality of coupling apertures that are sized and threaded in a manner that enables them to receive and engage the threading of standard climbing hold bolts.

When the frame is mounted to a climbing surface of a conventional climbing wall (e.g., using standard climbing hold bolts, etc.), it will protrude somewhat from the climbing surface. Accordingly, the frame may include transition features at its sides. Each transition feature may extend from an outside surface of a corresponding side wall of the frame to the climbing surface in a manner that provides a smooth transition (e.g., a taper, etc.). In some embodiments, the transition features at the sides of the frame may comprise outward extensions from the coupling decks of the frame.

The same size frame may be capable of receiving and engaging pods with cracks of different shapes and sizes so a gym can provide versatility and variety for climbers. In embodiments where a series of frames can be arranged vertically, the frames could receive a series of pods with the same crack configuration, or combine pods with cracks of different sizes to more closely simulate a natural crack.

Each pod may include a body that defines a crack. The crack may extend from an outer surface of the pod at least partially into the body. The body may have a configuration that enables it to be received by the receptacle of the frame of the crack climbing module. More specifically, the pod may include two sides with outer surfaces that will oppose, or face, and that may be positioned in close proximity to (e.g., adjacent to, against, etc.) the inner surfaces of the side wall of the frame. The crack of the pod may extend along a length of the body and may be positioned somewhat centrally between the sides of the pod.

The outer surface of the pod may have a texture that resembles a natural texture of a rock face in which the crack defined by the pod could be found. Without limitation, such a surface could be smooth or rough. It could be relatively flat or include irregularities. While the crack of the pod may provide an individual with a simulated experience of a natural crack, the outer surface of the pod may provide the individual with a simulated experience of a surface into which a natural crack may extend.

Since a system according to this disclosure is modular (i.e., a variety of pods may be interchangeably used with a frame), the pods may have the same lengths—a unit length—or multiples of the unit length. Likewise, a length of the panel receptacle of the frame may frame may be the unit length or a multiple thereof. In embodiments where the pod has a crack configuration that enables it to be used in series with one or more other pods of a set of pods, the location of a crack at each end of the outer surface of the pod may be a fixed location, or location common, at an end of the pod. By placing an ends of crack of various pods at a fixed location, the assembly of such pods in series with one another may provide a continuous crack, even though the crack of one pod may have a shape that differs from a shape of the crack of every other pod of the set.

The manner in which the pod is coupled to the frame should be sufficient to hold the weight of the climber, as well as withstand forces exerted as an individual uses his or her jam strength in the crack to change his or her position on the climbing surface (e.g., to move up the wall, etc.). In this regard, the pod may include coupling features that enable it to be securely coupled to the frame of the crack climbing module. Without limitation, the pod may include coupling wings, or flanges, that extend outward from sides of the body of the pod to define a face of the pod. Each coupling wing may comprise an extension of the outer surface of the body of the pod, and include one or more coupling features that align with corresponding coupling features of a coupling deck of a frame of the crack climbing module. As an example, each coupling feature of a coupling wing of a pod may comprise an aperture that can receive and be engaged by the head of a standard climbing hold bolt.

A width of the crack in a pod may be adjustable. Adjustability of the width of the crack of a pod may be achieved in a variety of ways. In some embodiments, the sides of the body of a pod may be capable of being moved towards and/or away from one another. The sides of the body of such a pod may slide relative to one another. The sides of the body of such a pod may be separate from one another. In such embodiments, the pod may include coupling features that accommodate various possible widths of the body. Without limitation, a length of each coupling feature may be aligned with a direction in which the sides of the body move toward and/or away from one another, enabling the coupling feature to align with a corresponding coupling feature of the frame of the crack climbing module provided that the sides of the body of the pod are positioned close enough to one another that the body of the pod will fit within the receptacle of the frame. As an example, each coupling feature may include a series of apertures, which may be discrete from one another, that are configured to enable the sides of the body of the pod to be positioned a predetermined, or fixed, number of distances apart from each other between a minimum width and a maximum width of the body of the pod. Regardless of how the coupling features are configured, the relative positions of the sides and, thus, the width of the crack defined by a pod with moveable sides may be held in place as the pod is secured to the frame of the crack climbing module. A crack climbing module that includes such an adjustable pod may also include a frame that can accommodate the various possible widths of the adjustable pod; additionally, the coupling decks of such a frame may include features that are able to receive spacers that can mount flush with an outer surface of the adjustable pod to provide increased continuity across an outer surface of the crack climbing module.

The frame and, thus, the pod(s) of a crack climbing module may be oriented in any of a variety of different orientations along a climbing surface of a climbing wall, including vertically, horizontally, or any of a variety of different diagonal orientations between vertical and horizontal. A plurality of frames may be arranged in series across a portion of the climbing wall to enable the establishment of a single crack course up the climbing surface of the climbing wall or one or more frames may be positioned relative to conventional holds to provide a course that includes cracks and protrusions.

A crack climbing system according to this disclosure may include at least one frame and a plurality of interchangeable pods with different crack configurations from one another.

In another aspect, structures that can directly receive modular pods according to this disclosure are disclosed. As a non-limiting example, a permanent climbing wall of a climbing gym may include an elongated receptacle for one or more pods according to this disclosure. Use of the elongated receptacle with pods may enable periodic variation in a crack along the part of the climbing surface of the climbing wall along which the receptacle is located. Such a receptacle may be isolated from other features (e.g., climbing holds, etc.) or it may be used in conjunction with other climbing features.

An artificial climbing boulder is another example of a structure that may include one or more receptacles for a pod or series of pods according to this disclosure. The distinguishing characteristic between an artificial climbing boulder and an indoor climbing wall surface is that boulders are low enough in height (typically less than about 16 feet (or less than about 5 meters) that climbers do not require a safety belay. Such an artificial climbing boulder may include a plurality of climbing surfaces orientated at different angles or combinations of angles relative to the surface (e.g., a floor, a concrete slab, the ground, etc.) that supports the artificial climbing boulder.

As yet another example of a structure that can directly receive modular pods of this disclosure, a free-standing climbing tower according to this disclosure may comprise a frame that can support a climbing surface in a variety of orientations, including one or more orientations. A configuration of the frame may enable it to support a climbing surface, pods that have been secured to the climbing surface, and at least one individual as he or she ascends climbing surface. In some embodiments, the frame may be secured (e.g., bolted, etc.) to a horizontal surface (e.g., a floor, a concrete slab, etc.). In other embodiments, the frame may be portable, facilitating its movement and, thus, movement of the free-standing climbing tower from one location to another. The orientation(s) at which the frame may support the climbing surface include one or more inclined orientations (i.e., at an angle of greater than 90° between a surface that supports the frame and the climbing surface held by the frame), a vertical orientation (i.e., at an angle of about 90° between the surface that supports the frame and the climbing surface held by the frame), and/or one or more overhanging orientations (i.e., at an angle of less than 90° between the surface that supports the frame and the climbing surface held by the frame). Receptacles in the climbing surface of such a free-standing climbing tower may be capable of receiving and retaining (e.g., with standard climbing hold bolts, etc.) one or more pods according to this disclosure.

A method for designing a crack climb may include determining a course for a crack along a climbing surface of an existing climbing wall, as well as defining a crack. Once the course has been determined, one or more frames of a crack climbing module may be secured to the climbing surface. Definition of the crack may include selecting one or more pods that define all or a part of a desired crack, including one or more characteristics of the crack. Once a frame has been secured to the crack climbing surface, the one or more pods may be coupled to the frame. If a plurality of pods have been selected, they may be coupled to the frame in a series that provides the crack that has been designed. Optionally, the width of the crack or a portion thereof may be defined as a pod that defines that crack or portion thereof is coupled to the frame.

In designing a crack climb for a climbing surface that includes at least one receptacle for one or more pods, the crack may be defined by selecting one or more pods from a set of pods to define all or a part of a desired crack with one or more characteristics. Each pod may be installed in the receptacle and coupled to the climbing surface. If a plurality of pods have been selected, they may be coupled to the climbing surface in a series that provides the crack that has been designed. Optionally, the width of the crack or a portion thereof may be defined as a pod that defines that crack or portion thereof is coupled to the climbing surface.

When a new crack climbing challenge is desired, the pod(s) may be removed from the receptacle of its frame without removing the frame itself. In embodiments where the receptacle comprises a receptacle of a frame of a crack climbing module, the frame may be optionally removed from the climbing surface of the climbing wall, and recoupled to new locations of the climbing surface to define a new course over the climbing surface. The pod(s) may then be rearranged or replaced with one or more different pods to define a new crack.

A method for designing the crack of a pod may include obtaining an image of a natural crack and reproducing the natural crack as part of a pod. Such a method may include obtaining an information of a well-known crack, which may be used to define a pod or a series of pods that resemble the crack to enable an individual to practice climbing the crack in a safe, controlled environment before he or she travels to and attempts to climb that crack in nature.

Other aspects of the disclosed subject matter, as well as features and advantages of various aspects of the disclosed subject matter, should become apparent to those of ordinary skill in the art through consideration of the ensuing description, the accompanying drawings, and the appended claims.

DETAILED DESCRIPTION

Figure 1:
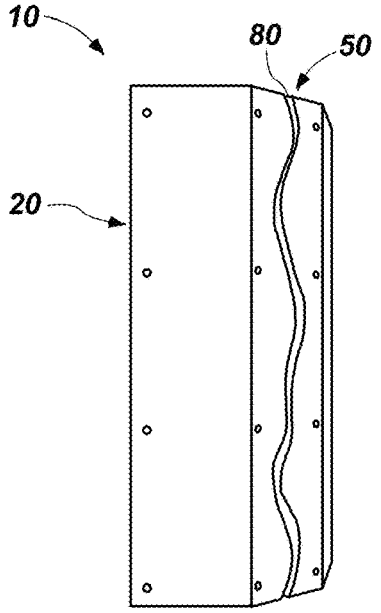
FIG. 1 is a partial perspective view of an embodiment of a crack climbing module according to this disclosure.
Figure 2:
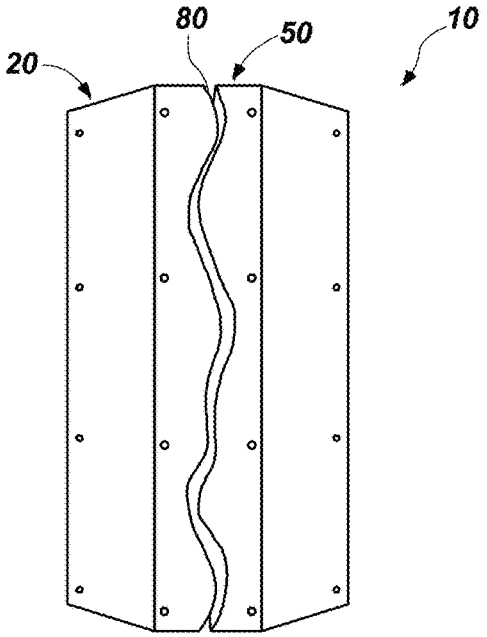
FIG. 2 is a front view of the embodiment of crack climbing module shown in FIG. 1.

With reference to FIGS. 1 and 2, an embodiment of a crack climbing module 10 includes a frame 20 and a pod 50 that defines a crack 80. The frame 20 may have a configuration that enables it to be secured, or mounted, to a climbing surface of a conventional climbing wall (not shown in FIG. 1 or FIG. 2). A configuration of the pod 50 may enable it to be assembled with and securely coupled to the frame 20 and, thus, to a climbing surface of the climbing wall to which the frame 20 has been mounted. The lengths of the frame 20 and the pod 50 may contribute to their modularity. As an example, the pod 50 may have a defined unit length, and length of the frame 20 may be the unit length or an integer-based multiple of the unit length (i.e., 2× the unit length, 3× the unit length, 4× the unit length, etc.). In a specific embodiment, the frame 20 and the pod 50 may both have lengths of about 48 inches (about 120 cm).

FIGS. 3-6 depict an embodiment of a frame 20. The frame 20 includes a base 22, which defines a rear of the frame 20 and may be secured to the climbing surface of a conventional climbing wall (not shown in any of FIGS. 3-6). A pair of side walls 26 protrude from the base 22, toward a front of the frame 20. Coupling decks 32, which may define a front of the frame 20, may extend outwardly from forward portions of the side walls 26, in opposite directions from one another. Transition features 36 may extend further outward from outer edges of the coupling decks 32, toward the plane in which the base 22 is located. Support flanges 42 may extend from outer edges of the transition features 36, inwardly towards the base 22.

The base 22 of the frame 20 may include a plurality of mounting features 24 that can be used to mount the frame 20 to a climbing surface of a conventional climbing wall. The mounting features 24 may include apertures, such as the slots depicted by FIG. 4, circular apertures, or other shapes of apertures that correspond to and can be aligned with corresponding mounting features (e.g., t-nuts, etc.) in the climbing surface. The apertures of the mounting features 24 may be large enough to receive suitable coupling elements (e.g., threaded elements of standard climbing hold bolts, etc.) that will engage and/or be engaged by the corresponding mounting features in the climbing surface. The apertures of the mounting features 24 may be small enough, or include features that are small enough, to be engaged by features of the coupling elements (e.g., the heads of standard climbing hold bolts, etc.) and to thereby secure the base 22 to the climbing surface. In a specific embodiment, the mounting features 24 may comprise elongated apertures in a staggered arrangement, which may provide for tolerance for variance in the positioning of t-nuts in the climbing surface. The size and shape of each aperture may remain constant through the thickness of the base 22 or each aperture may include a countersink or a counterbore that enables it to receive at least part of an engaging portion of a coupling element (e.g., a head of a standard climbing hold bolt, etc.).

The side walls 26 of the frame 20 may extend in a forward direction from the base 22. In some embodiments, the side walls 26 may extend from sides of the base 22; the side walls 26 may even be continuous with the sides of the base 22. The side walls 26 may be oriented parallel to one another. Together, the base 22 and the side walls 26 may define a receptacle 30 of the frame 20. A distance between inner surfaces 28 of the side walls 26 may define a width of the receptacle 30. Depths of the side walls 26, or the distance each side wall 26 protrudes beyond a front surface of the base 22, may define a depth of the receptacle 30. In some embodiments, the receptacle 30 may have a width of about 6 inches (about 15.2 cm) and a depth of about 6 inches (about 15.2 cm) or about 8 inches (about 20.3 cm); a width of about 8 inches (about 20.3 cm) and a depth of about 6 inches (about 15.2 cm), about 8 inches (about 20.3 cm), or about 10 inches (about 25.4 cm); or a width of about 10 inches (about 25.4 cm) and a depth of about 6 inches (about 15.2 cm), about 8 inches (about 20.3 cm), about 10 inches (about 25.4 cm), or about 12 inches (about 30.5 cm). Of course, the receptacle 30 may have a variety of other widths, depths, and combinations of widths and depths. In a specific embodiment, the frame 20 may include a receptacle 30 with a width of about 8 inches (about 20.3 cm) and a depth of about 10 inches (about 25.4 cm).

The coupling decks 32 of the frame 20 may be oriented substantially parallel to the base 22 of the frame 20. Additionally, the coupling decks 32 may reside within the same plane (i.e., they may be coplanar). Each coupling deck 32 may include a series of coupling features 34. Each coupling feature 34 have a configuration that enables it engage or be engaged by a corresponding coupling feature of a pod 50 (FIGS. 1 and 2) upon introduction of the pod 50 into the receptacle 30 of the frame 20. As a nonlimiting example, each coupling feature 34 may comprise an internally threaded aperture that can receive an externally threaded portion of a standard climbing hold bolt. Continuing with the specific embodiment provided previously herein, each coupling deck 32 of the frame 20 may have a width of about 2¼ inches (about 5.7 cm).

Each transition feature 36 of the frame 20 may extend outwardly from a corresponding coupling deck 32, and rearwardly toward a plane in which the base 22 of the frame 20 resides. An inner edge 38 of each transition feature 36, which is adjacent to an outer edge of the corresponding coupling deck 32, may protrude slightly beyond a front surface, or an outer surface, of each coupling deck 32. The distance the inner edge 38 protrudes beyond the front surface of the adjacent coupling deck 32 may be the same as or substantially the same as the width of a feature of the pod 50 (FIGS. 1 and 2) that rests upon the coupling deck 32 when the pod 50 is introduced into the receptacle 30 of the frame 20.

An outer surface of each transition feature 36 may be oriented at an angle that provides smooth transition between the coupling decks 32 and a climbing surface to which the frame 20 is mounted. An outer edge 40 of each transition feature 36 may extend to a location that will be positioned adjacent to, or even abut, the climbing surface to which the frame 20 is mounted.

A support flange 42 may extend from the outer edge 40 of each transition feature 36 toward the base 22 of the frame 20. Each support flange 42 may be coplanar with the base 22. Mounting features 44 positioned along the outer edge 40 of each transition feature 36 may align with corresponding mounting features 46 of each support flange 42 to enable the transition feature 36 to be secured to a climbing surface and, thus, to enable the frame 20 to be further secured to the climbing surface. As an example, the coupling mounting 44 and 46 may comprise aligned apertures that may be aligned with corresponding mounting features of (e.g., t-nuts in, etc.) the climbing surface to enable coupling elements (e.g., standard climbing hold bolts, etc.) to secure the transition features 36 to the climbing surface. In the previously provided specific embodiment, each transition feature 36 may be oriented at an angle of about 40.40° from its corresponding coupling deck 32 and extend a lateral distance of about 11¾ inches (about 30 cm) beyond the outer extent of its corresponding coupling deck 32, imparting the frame 20 with a width of about 36 inches (about 90 cm).

The various features of the frame 20 may be defined in any suitable manner that may impart the frame 20 with sufficient structural integrity to hold the weight of at least one individual as he or she climbs the climbing surface of a climbing wall to which the frame 20 has been mounted and to withstand forces exerted thereon as an individual who is climbing the climbing surface uses his or her grip in a crack of a pod 50 (FIGS. 1 and 2) carried by the frame 20 to change his or her position on the climbing surface (e.g., to move up the wall, etc.). As an example, the frame 20 may be pressed from a sheet of a ductile material, such as steel (e.g., 0.25 inch (about 6 mm) thick steel, etc.), stainless steel, aluminum, or another suitable metal. As another example, the frame 20 may be formed from a moldable material, such as a carbon fiber-reinforced polymer or the like. Of course, other methods may be used to manufacture a frame 20 from one or more materials appropriate to such methods.

Turning now to FIGS. 7-10, an embodiment of a pod 50 of a crack climbing module 10 (FIGS. 1 and 2) is described. The pod 50 includes two sides 52 and 62 that are at least partially spaced apart from one another to define a crack 80 therebetween. In some embodiments, the two sides 52 and 62 of the pod 50 may be secured to one another (e.g., by way of a connector 82 at a base of the crack 80, etc.). In other embodiments, the sides 52 and 62 of the pod 50 may be separate from one another, which may impart the crack 80 defined therebetween with an adjustable width.

Each side 52, 62 of the pod 50 may include a body 53, 63 and a coupling wing 54, 64, or flange. Outer surfaces 56 and 66 of the coupling wings 54 and 64 may define a front surface, or an outer surface or face, of the pod 50. The bodies 53 and 63 may extend rearward from back sides of the coupling wings 54 and 64.

Each body 53, 63 may include a side wall 55, 65. It is the side walls 55 and 65 that define the crack 80 of the pod 50. More specifically, the side walls 55 and 65 may be at least partially spaced apart from one another, with interior surfaces 60 and 70 of the side walls 55 and 65, respectively, being opposed to one another, or facing each other, to define the crack 80. The depths of the side walls 55 and 65 (i.e., the dimensions from their corresponding coupling wings 54 and 64 to their lower extents in the orientations shown in FIGS. 7 and 9) define the depth of the crack 80 defined between the side walls 55 and 65. For example, a crack 80 with a width suitable for so-called "finger climbing" may have a depth of about 6 inches (about 15.2 cm). A wider crack 80 that can accommodate an individual's hands or fists may have a depth of about 10 inches (about 25.4 cm).

Figure 8:
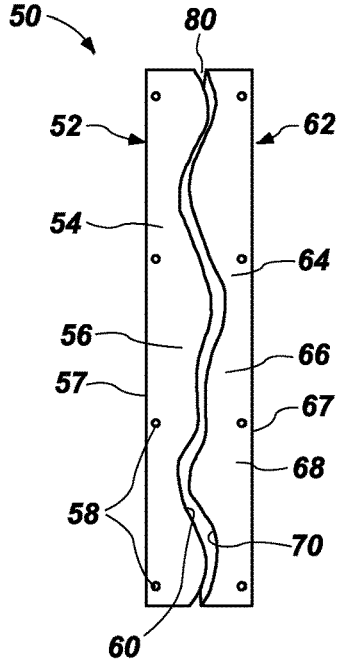
FIG. 8 is a front view of the embodiment of pod shown in FIG. 7.
Figure 7:
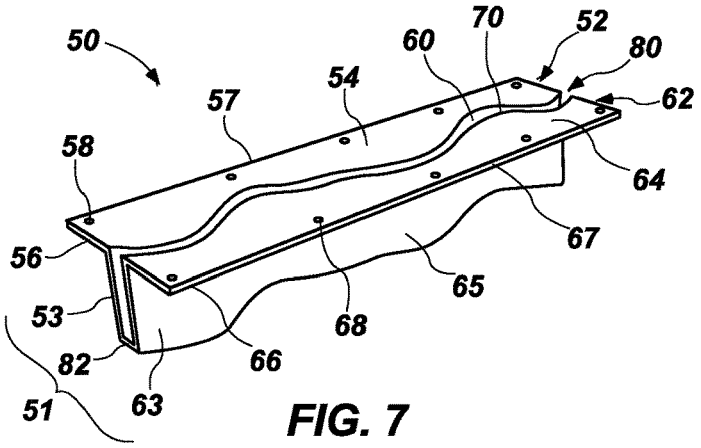
FIG. 7 is a perspective view of an embodiment of a pod of the embodiment of crack climbing module shown in FIGS. 1 and 2, which may be assembled with the embodiment of frame shown in FIG. 3.
Figure 10:
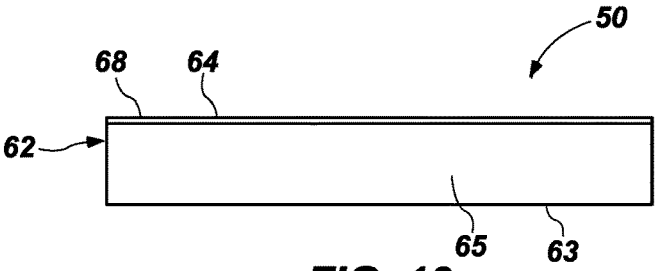
FIG. 10 is a side view of the embodiment of pod shown in FIG. 7.

As illustrated by FIG. 7, and as is apparent from the embodiment of crack 80 shown in FIG. 8, each side wall 55, 65 may extend non-linearly along the height of the pod 50 (from left to right in FIG. 7, from top to bottom in FIG. 8) to define a non-linear crack 80. As an alternative to the meandering curved configuration shown in FIG. 7, each side wall 55, 65 may have a jagged configuration, a configuration with straight portions, or a configuration with any combination of curved portions, jagged portions, and straight portions. In some embodiments, the interior surfaces 60 and 70 of the side walls 55 and 65 may mirror one another, providing a crack 80 with a constant width. In other embodiments, one or more locations on the interior surface 60 of one side wall 55 may vary from corresponding locations on the interior surface 70 of the other side wall 65, which may introduce variation into the crack 80 (e.g., variations in width, variations in internal features, variations in texture, etc.).

Figure 9:
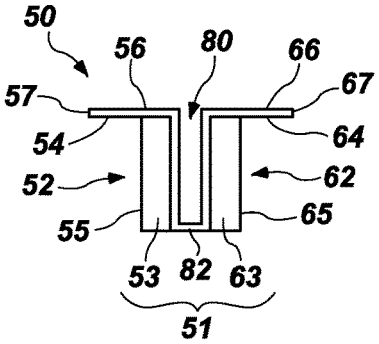
FIG. 9 is an end view of the embodiment of pod shown in FIG. 7.

As illustrated by FIGS. 7 and 9, the coupling wings 54 and 64 of the pod 50 may be oriented transversely to and extend outwardly from their corresponding side walls 55 and 65. In some embodiments, the coupling wings 54 and 64 may be oriented perpendicular to their corresponding side walls 55 and 65. An outer edge of each coupling wing may 54, 64 be configured as a portion of a rectangle, with the coupling wings 54 and 64 collectively imparting the front surface of the pod 50 with a rectangular configuration.

Each coupling wing 54, 64 may have a configuration that enables it to rest against a corresponding coupling deck 32 (FIGS. 3-5) of a frame 20 (FIGS. 3-6) of the crack climbing module 10 (FIGS. 1 and 2). As illustrated, the coupling wings 54 and 64 may comprise relatively flat, or planar, structures. In a specific embodiment, each coupling wing 54, 64 may have a thickness of about ¼ inch (about 6 mm).

A series of coupling features 58, 68 may be positioned adjacent to an outer edge 57, 67 of each coupling wing 54, 64. When the coupling wings 54 and 64 are positioned against corresponding coupling decks 32 (FIGS. 3-5) of a frame 20 (FIGS. 3-6) of the crack climbing module 10 (FIGS. 1 and 2), the coupling features 58 and 68 of the coupling wings 54 and 64 may align with corresponding coupling features 34 (FIGS. 3 and 4) of the coupling decks 32. In a specific embodiment, each coupling feature 58, 68 may comprise an aperture that may receive a securing portion of a coupling element (e.g., an externally threaded portion of a standard climbing hold bolt, etc.). Such an aperture may also enable an engaging portion of a coupling element (e.g., a head of a standard climbing hold bolt, etc.) to engage the coupling wing 54, 64. In embodiments where the aperture extends straight through the coupling wing 54, 64, the engaging portion of the coupling element may engage the coupling wing 54, 64 at locations immediately surrounding the aperture. Alternatively, the aperture may comprise a countersink or a counterbore that enables it to receive the engaging portion of the coupling element and that enables the engaging portion of the coupling element to engage a portion of the surface that defines the aperture.

The materials from which the pod 50 is formed, a structure of the pod 50, and/or a manner in which the pod 50 is mounted to a climbing surface (e.g., by way of a frame 20 of a crack climbing module 10 (FIGS. 1 and 2) may be sufficient to hold the weight of an individual, as well as withstand forces exerted as an individual uses his or her grip in the crack 80 to change his or her position on a climbing surface (e.g., to move up the climbing surface, etc.) (e.g., to move up the climbing surface, etc.) to which the pod 50 has been secured (e.g., by a frame 20, etc.). For example, the pod 50 may be molded from a polymer, which may comprise a fiber-reinforced polymer. The polymer may comprise a material that has sufficient hardness and strength to withstand the forces that will be exerted against the pod 50 as individual climbs the crack 80. Examples of polymers include, but are not limited to, polyurethanes of suitable hardnesses and strengths, fiberglass, and any other suitable materials. Surfaces of the pod 50 that are to be contacted by an individual as he or she climbs the crack 80 (e.g., the outer surface 56, 66 of each coupling wing 54, 64; the inner surface 60, 70 of each side wall 55, 65; etc.) may be coated with a material that provides those surfaces with a texture that resembles the texture of the face of a natural stone formation.

In a specific embodiment, a pod 50 according to this disclosure may be fabricated by defining a crack in a blank (e.g., a block of foam, etc.) to form a so-called "plug," or a form. The crack 80 may be defined by hand, with a computer numeric control (CNC) machine, or in any other suitable manner. Once the crack and the remainder of the plug have been defined, the plug may be used to form a fiberglass mold in a manner known in the art. The fiberglass mold may then be used to define one or more pods 50 from a suitable material (e.g., fiberglass, polyurethane, etc.) in a manner known in the art. Various features of the pod 50, including, but not limited to, the outer edges 57, 67 and the coupling features 58, 68 of each coupling wing 54, 64, may then be defined in a manner known in the art (e.g., with suitable cutting tools, drills, etc.). Outer surfaces of the pod 50, including the interior surfaces 60 and 70 that define the crack 80 of the pod 50, may be coated in a manner known in the art.

Figure 4:
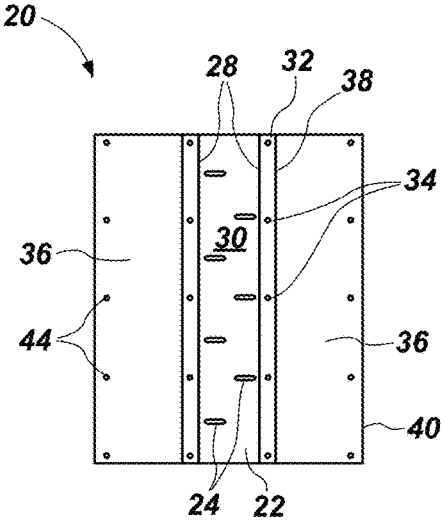
FIG. 4 is a front view of the embodiment of frame shown in FIG. 3.
Figure 3:
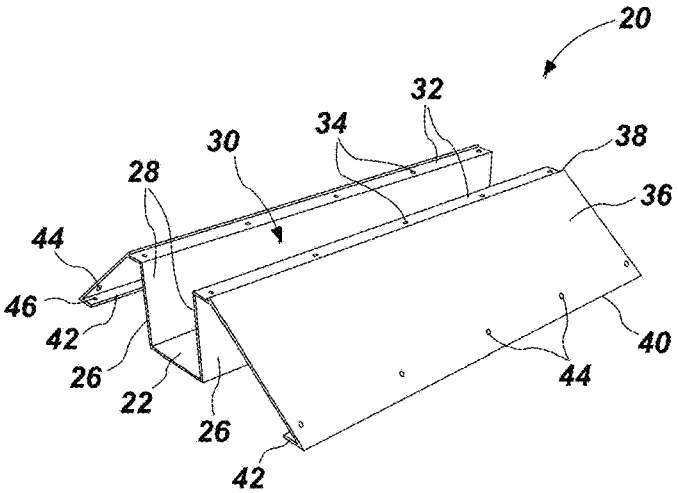
FIG. 3 provides a perspective view of an embodiment of a frame of the embodiment of crack climbing module shown in FIGS. 1 and 2.
Figure 5:
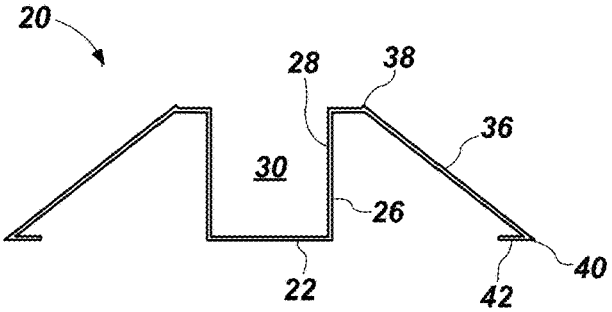
FIG. 5 is an end view of the embodiment of frame shown in FIG. 3.
Figure 6:
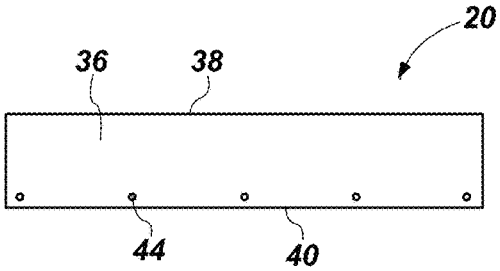
FIG. 6 is a side view of the embodiment of frame shown in FIG. 3.
Figure 13:
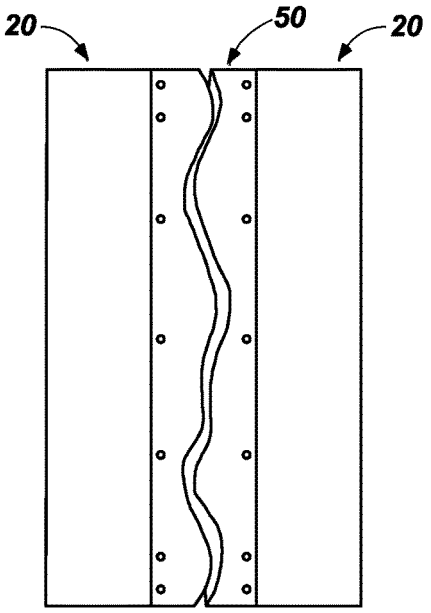
FIG. 13 is a front assembly view of the embodiment of pod of FIG. 7 and the embodiment of frame of FIG. 3.
Figure 11:
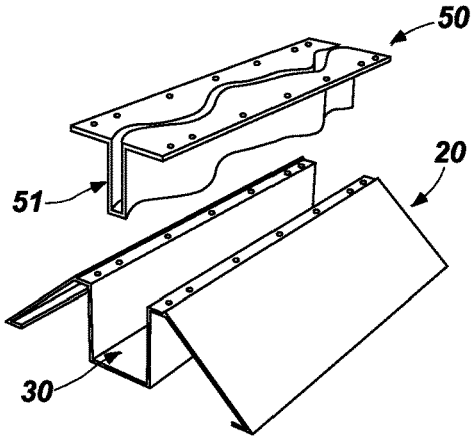
FIG. 11 is a perspective assembly view of the embodiment of pod of FIG. 7 and the embodiment of frame of FIG. 3.
Figure 12:
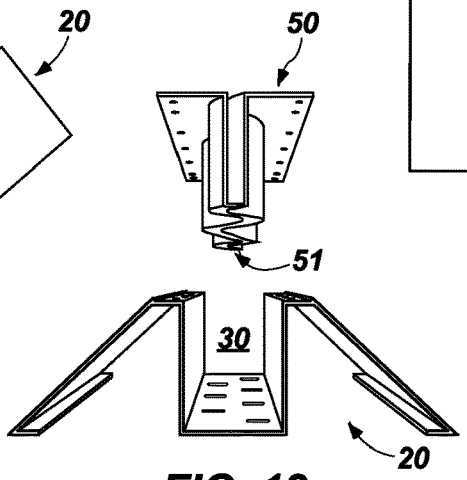
FIG. 12 is an end assembly view, in perspective, of the embodiment of pod of FIG. 7 and the embodiment of frame of FIG. 3.

The bodies 53 and 63 of the two sides 52 and 62 of the pod 50 may collectively define a body 51 of the pod 50. As depicted by FIGS. 11-13, a configuration of the body 51 of the pod 50 may enable it to be received by the receptacle 30 (FIGS. 3-5) of a frame 20 (FIGS. 3-5).

Turning now to FIGS. 14-20, a crack climbing module 10' (FIGS. 18-20) that includes an adjustable pod 50' (FIGS. 18-20) may also include a frame 20' that can accommodate the various possible widths of the adjustable pod 50'.

As shown in FIGS. 14-17, the receptacle 30' of such a frame may have a width that will accommodate the various possible widths of the adjustable pod 50'. In comparison to the specific embodiment of frame 20 described in reference to FIGS. 3-6, which has a receptacle 30 that is about 8 inches (about 20.3 cm) wide and a depth of about 10 inches (about 25.4 cm), a specific embodiment of a frame 20' that can accommodate various widths of an adjustable pod 50' may include a receptacle 30' with a width of about 9½ inches (about 24 cm) and a depth of about 10 inches (about 25.4 cm).

Additionally, the coupling decks 32' of such a frame 20' may be wider—for example, about 3 inches (about 7.6 cm) as opposed to about 2¼ inches (about 5.7 cm). With added reference to FIGS. 18-20, such an increased width may enable the coupling decks 32' to accommodate the different overlapping positions of the coupling wings 54', 64' of a pod 50' over the coupling decks 32' as the width of the pod 50' is adjusted. The increased width of each coupling deck 32' may also enable a spacer 90, 92 (FIGS. 19 and 20, respectively) to be positioned between an outer edge of a coupling wing 54', 64' and an outer extent each coupling wing 54', 64' to provide the crack climbing module 10' with a substantially continuous outer surface regardless of the width of the pod 50'.

Despite the increased widths of the receptacle 30' and the coupling decks 32' (e.g., a total increase of about 3 inches (about 7.6 cm), etc.), the frame 20' may have the same width as the embodiment of frame 20 described in reference to FIG. 3-6 (e.g., about 36 inches (about 90 cm), etc.). As a result, the lengths of the transition features 36' may be shorter than the transition features 36 of frame 20 and the transition features 36' may be oriented at steeper angles than the transition features 36 of frame 20.

Figure 15:
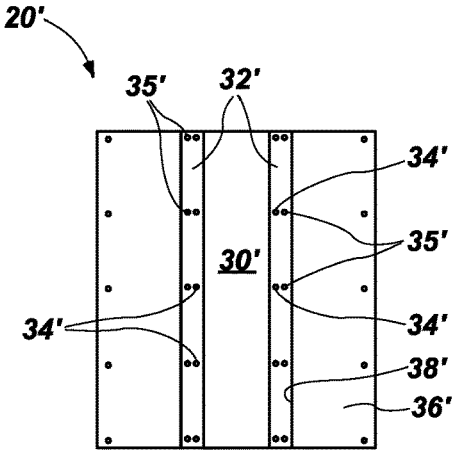
FIG. 15 is a front view of the embodiment of frame shown in FIG. 14.
Figure 14:
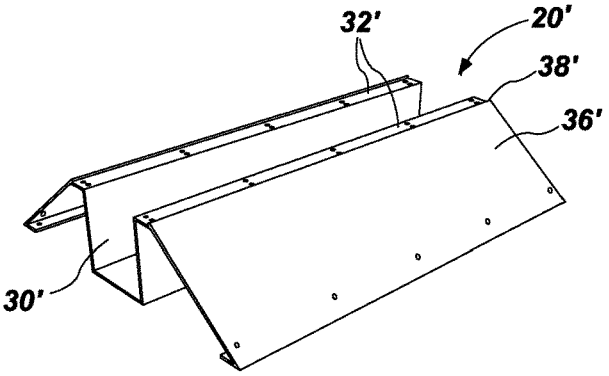
FIG. 14 provides a perspective view of another embodiment of a frame of a crack climbing module with a pod with an adjustable width; the embodiment of frame shown in FIG. 14 has a configuration that enables it to accommodate a variety of different widths of the pod.
Figure 16:
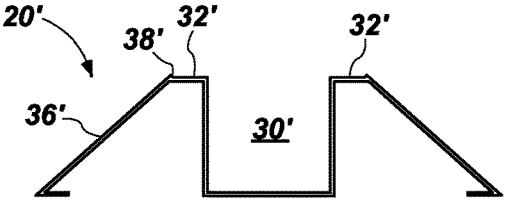
FIG. 16 is an end view of the embodiment of frame shown in FIG. 14.
Figure 17:
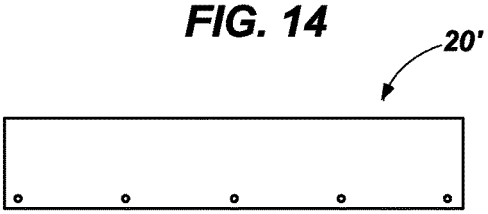
FIG. 17 is a side view of the embodiment of frame shown in FIG. 14.
Figure 18:
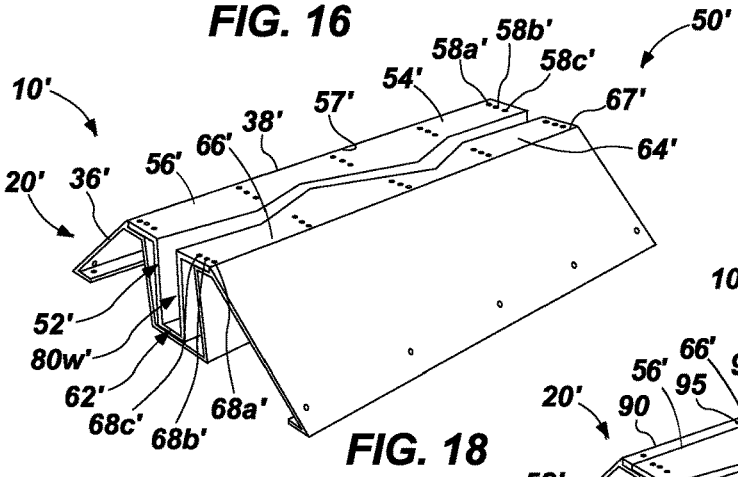
FIG. 18 is a perspective view of an embodiment of crack climbing module that includes the embodiment of frame shown in FIG. 14 and a pod in a wide setting.
Figure 19:
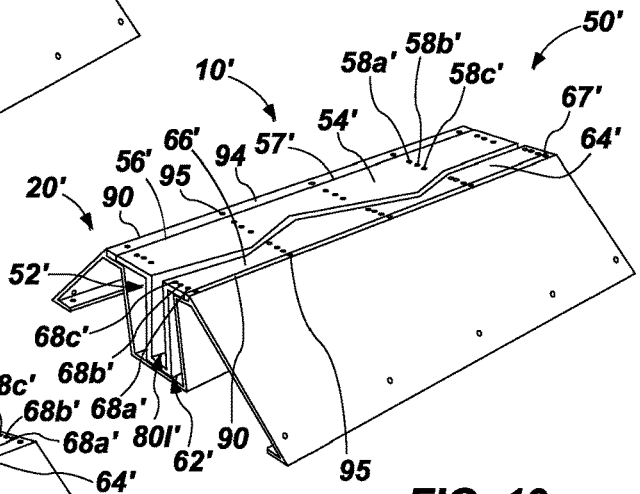
FIG. 19 is a perspective view of the embodiment of crack climbing module shown in FIG. 18 with the pod in an intermediate setting, and a pair of intermediate spacers secured adjacent to outside edges of coupling features of the pod.
Figure 20:
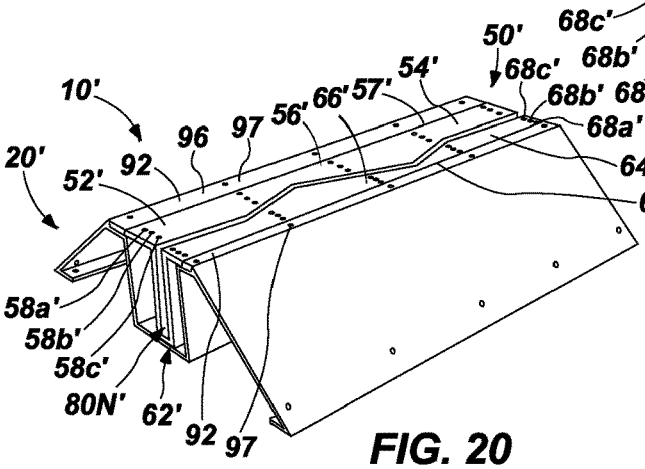
FIG. 20 is a perspective view of the embodiment of crack climbing module shown in FIG. 18 with the pod in a narrow setting, and a pair of wide spacers secured adjacent to outside edges of coupling features of the pod.

Each coupling deck 32' may include at least two columns of coupling features 34' and 35', as shown in FIG. 15. One or more columns of coupling features 34' may be positioned adjacent to the sides of the receptacle 30' to align with one or more corresponding columns of coupling features 58', 68' of the coupling wings 54', 64' of the pod 50', as depicted by FIGS. 18-20. The other column of coupling features 35' may be positioned adjacent to the outer extent of each coupling deck 32', next to an inner edge 38' of the transition feature 36'. When the pod 50' is in its widest arrangement, as illustrated by FIG. 18, the coupling features 35' may align with outermost sets of coupling features **58*a*', 68*a*' of the coupling wings 54', 64' of the pod 50'. When the pod 50' is in an intermediate arrangement, as shown in FIG. 19, or in its narrowest arrangement, as seen in FIG. 20, the coupling features 35' may align with corresponding coupling features 95, 97 of a spacer 90, 92, to facilitate coupling of the spacer 90, 92 to a coupling deck 32' of the frame 20'**.

A pod 50' whose width can be adjusted may include sides 52' and 62' that are separate from one another. In addition, the coupling wings 54' and 64' of a width-adjustable pod 50' may include a plurality of columns of coupling features **58*a*', 58*b*', 58*c*' and 68*a*', 68*b*', 68*c*' positioned at increasing distances away from the outer edges 57' and 67' of the coupling wings 54' and 64'**.

In FIG. 18, the sides 52' and 62' of the pod 50' are spaced as far apart from one another as the receptacle 30' of the frame 20' will permit, providing the crack climbing module 10' with a wide crack 80*w*'. In FIG. 19, the sides 52' and 62' of the pod 50' are secured to the frame 20' at an intermediate distance apart from one another, defining a crack $\mathbf{80}_1$' with an intermediate width. In FIG. 20, the sides 52' and 62' of the pod 50' are positioned as close to one another as the frame 20' will permit, providing the crack climbing module 10' with a narrow crack $\mathbf{80}_N$'.

Figure 21:
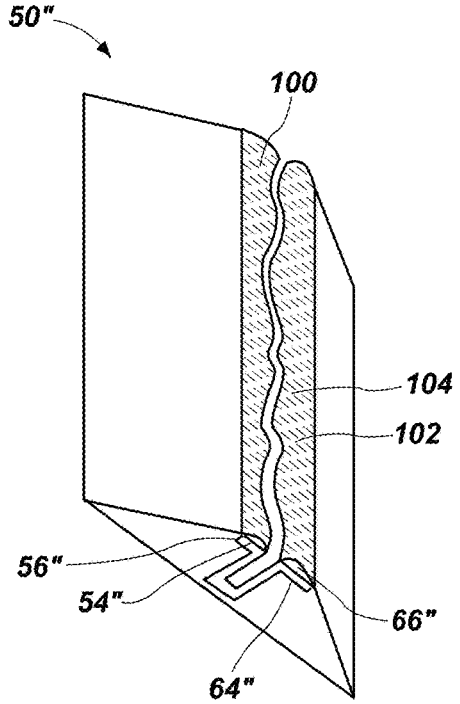
FIG. 21 is a perspective view of the embodiment of a pod that includes a textured outer surface.
Figure 22:
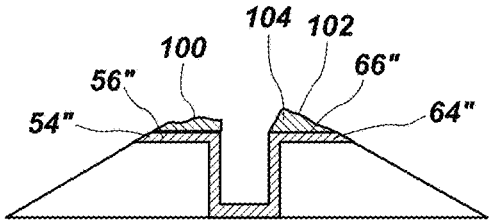
FIG. 22 is an end view of an embodiment of the pod shown in FIG. 21.

The outer surfaces 56, 66 of the coupling wings 54, 64 of the embodiment of pod 50 depicted by FIGS. 1, 2, and 7-13 and the outer surfaces 56', 66' of the coupling wings 54', 64' of the embodiment of pod 50' depicted by FIGS. 18-20, along with outer surfaces 94 and 96 of the embodiments of spacers 90 and 92 that are shown in FIGS. 19 and 20, respectively, are smooth and coplanar, or flush. Alternatively, as illustrated by FIGS. 21 and 22, the outer surfaces 56" and 66" of the coupling wings 54" and 64" of a pod 50" (e.g., pod 50, pod 50", etc.), as well as the front surfaces of any spacer (e.g., spacer 90 (FIG. 19), spacer 92 (FIG. 20), etc.) used with the pod 50", may include textures 100, undulations 102, protrusions 104, or other irregularities that may impart the pod 50" with a natural texture.

Figure 23:
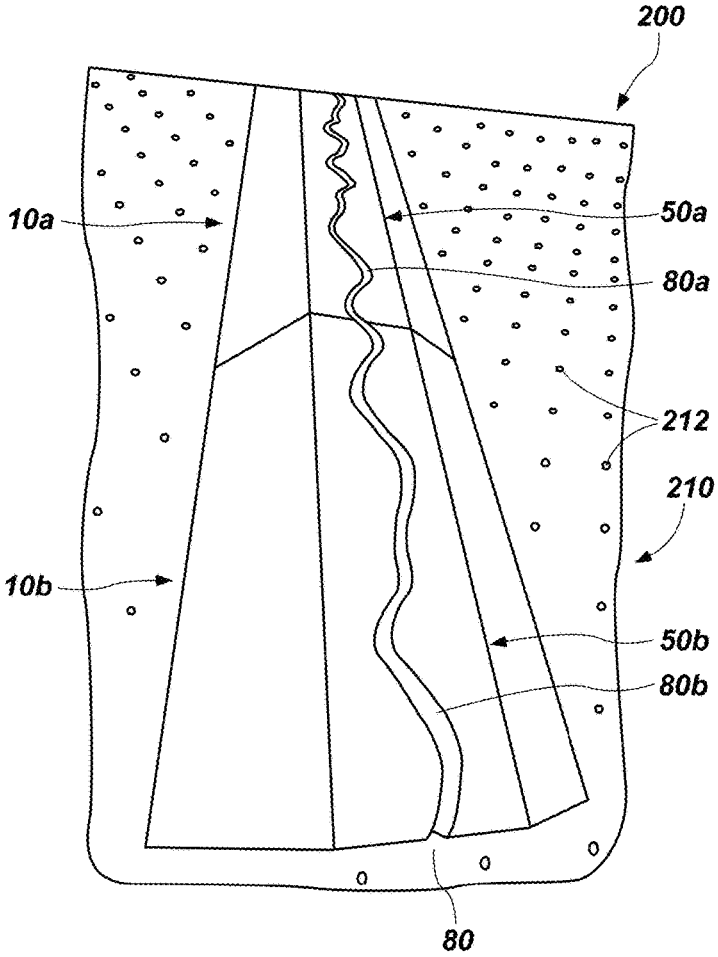
FIG. 23 illustrates an embodiment of a fixed indoor climbing wall to which a series of crack climbing modules have been mounted.

As indicated previously herein, and as shown in FIG. 23, a frame 20 (FIGS. 1-6 and 11-13), 20' (FIGS. 14-20) may be mounted to mounting features 212 (e.g., t-nuts, etc.) in a climbing surface 210 of a conventional climbing wall to enable one or more pods 50 (FIGS. 1, 2 and 7-12), 50' (FIGS. 18-20), 50" (FIGS. 21 and 22) to be selected and secured in place over the climbing surface 210. Specifically, FIG. 23 illustrates two crack climbing modules 10*a* and 10*b* that have been arranged end-to-end, in series, on the climbing surface 210 of a climbing wall. The crack climbing modules 10*a* and 10*b* include pods 50*a* and 50*b* with cracks 80*a* and 80*b* that have different shapes. Ends of the cracks 80*a* and 80*b* are positioned to enable pods 50*a* and 50*b* of different configurations to be aligned with one another in a manner that forms a continuous crack 80 over a portion of the climbing surface 210.

Figure 24:
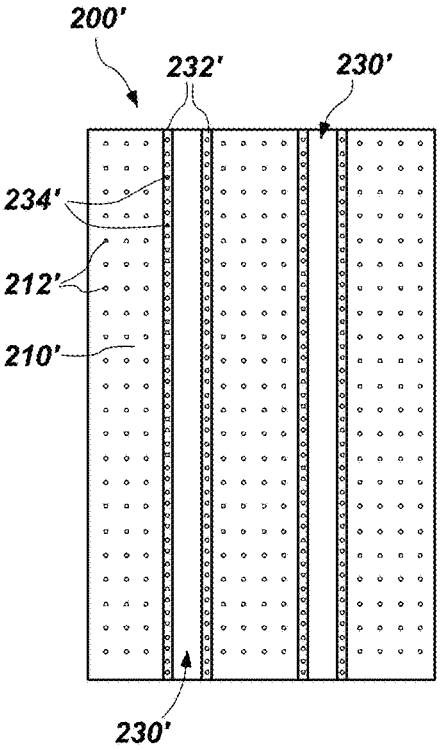
FIG. 24 represents an embodiment of a fixed climbing wall with a receptacle that can receive one or more pods, such as the embodiment of pod shown in FIG. 7.

FIG. 24 illustrates an embodiment of a fixed climbing wall 200' with a climbing surface 210' that includes an array of coupling features 212'. The coupling features 212' may enable conventional climbing holds to be mounted to the climbing surface 210'. In addition, one or more receptacles 230', or channels, may be recessed in the climbing surface 210'. A coupling deck 232' may be recessed within the climbing surface 210' on each side of a receptacle 230'. Coupling features 234' (e.g., t-nuts, etc.) may be positioned along each coupling deck 232'. Each receptacle 230' may enable one or more pods 50 (FIGS. 1, 2 and 7-12), 50' (FIGS. 18-20), 50" (FIGS. 21 and 22) to be positioned along the climbing surface 210', while the coupling decks 232' at the sides of the receptacle 230' and the coupling features 234' may enable each pod 50, 50', 50" to be secured directly to the fixed climbing wall 200'. When a pod 50, 50', 50" is mounted to the fixed climbing wall 200', an outer surface of the pod 50, 50', 50" may be coplanar with the climbing surface 210'.

Figure 25:
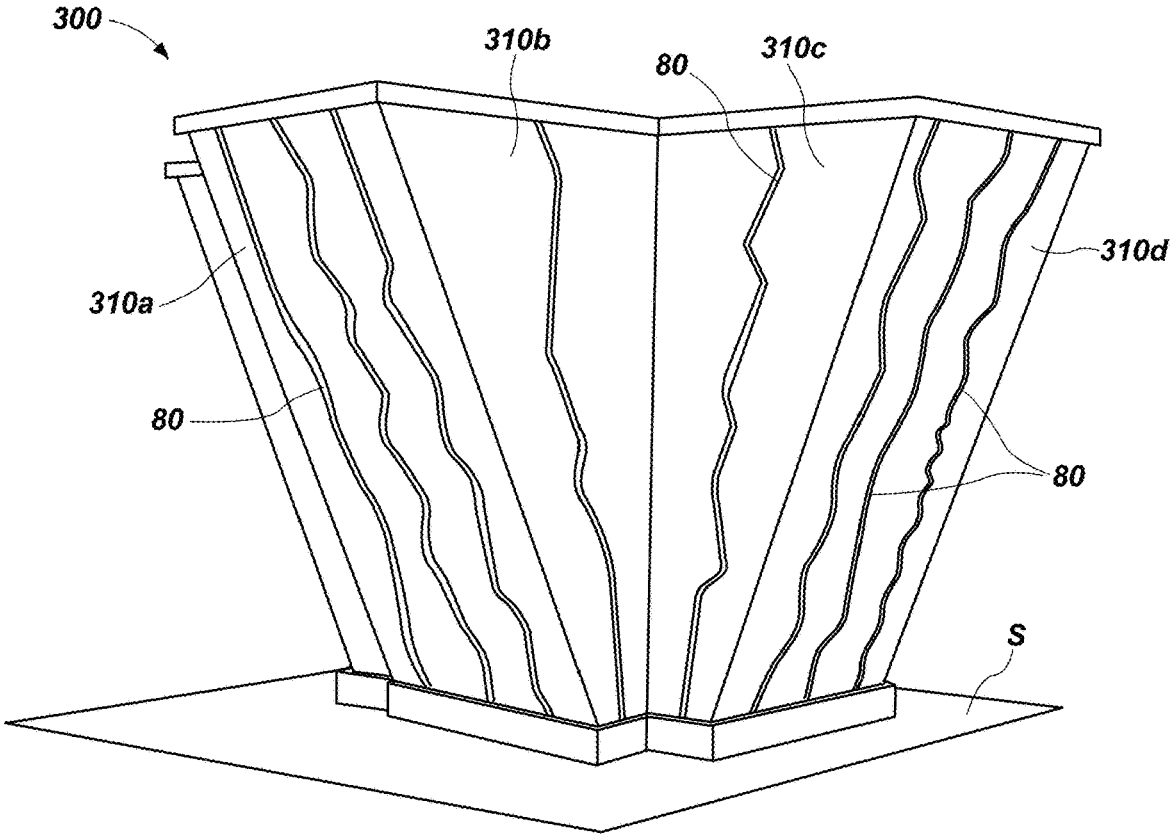
FIG. 25 shows an embodiment of an artificial crack climbing boulder.

FIG. 25 depicts an embodiment of an artificial climbing boulder 300. An artificial climbing boulder 300 may include a plurality of climbing surfaces 310*a*, 310*b*, etc., orientated at different angles or combinations of angles relative to the surface S (e.g., a floor, a concrete slab, the ground, etc.) that supports the artificial climbing boulder 300. The artificial climbing boulder 300 may be configured similarly to the fixed climbing wall 200' shown in and described with reference to FIG. 24—it may include receptacles 230' that receive pods 50 (FIGS. 1, 2 and 7-12), 50' (FIGS. 18-20), 50" (FIGS. 21 and 22) that define cracks 80 over one or more climbing surfaces 310*a*, 310*b*, etc., of the artificial climbing boulder 300.

Figure 26:
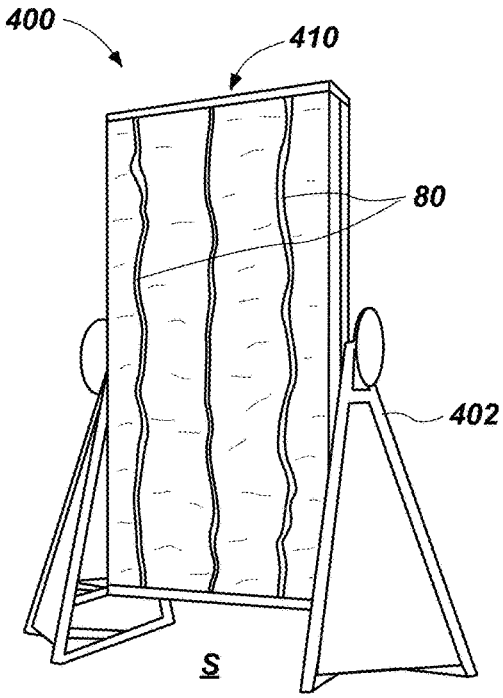
FIGS. 26 and 27 depict an embodiment of a portable crack climbing tower.
Figure 27:
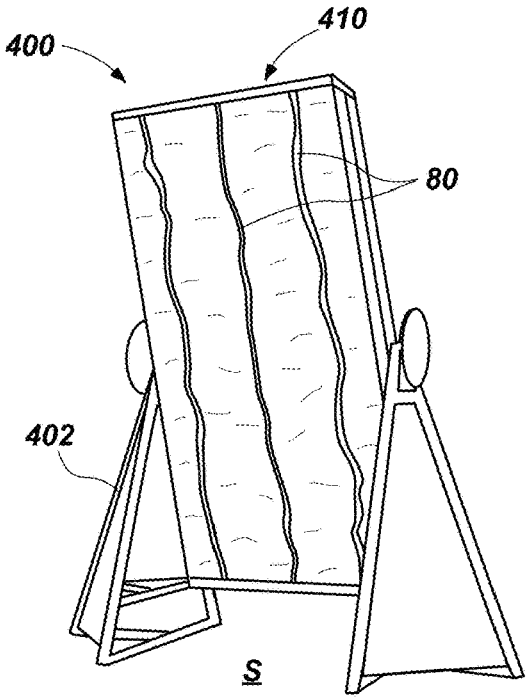

As yet another example of a structure that can directly receive modular pods of this disclosure, FIGS. 26 and 27 illustrate a free-standing climbing tower 400. The free-standing climbing tower 400 may include a frame 402 that can support a climbing surface 410 in a variety of orientations, including one or more orientations. A configuration of the frame 402 may enable it to support a climbing surface 410, pods 50 (FIGS. 1, 2 and 7-12), 50' (FIGS. 18-20), 50" (FIGS. 21 and 22) that have been secured to the climbing surface 410, and at least one individual as he or she ascends climbing surface 410. In some embodiments, the frame 402 may be secured (e.g., bolted, etc.) to a horizontal surface S (e.g., a floor, a concrete slab, etc.). In other embodiments, the frame 402 may be portable, facilitating its movement and, thus, movement of the free-standing climbing tower 400 from one location to another. The orientation(s) at which the frame 402 may support the climbing surface 410 include one or more inclined orientations (i.e., at an angle of greater than 90° between a surface S that supports the frame 402 and the climbing surface 410 held by the frame 402), the vertical orientation shown in FIG. 26 (i.e., at an angle of about 90° between the surface S that supports the frame 402 and the climbing surface 410 held by the frame 402), and/or one or more overhanging orientations (i.e., at an angle of less than 90° between the surface S that supports the frame 402 and the climbing surface 410 held by the frame 402), as shown in FIG. 27. The climbing surface 410 of the free-standing climbing tower 400 may include one or more receptacles (e.g., the receptacles 230' shown in FIG. 24, etc.), which can receive pods 50 (FIGS. 1, 2 and 7-12), 50' (FIGS. 18-20), 50" (FIGS. 21 and 22) and enable the pods 50, 50', 50" to be secured in place in a manner that defines cracks 80 over the climbing surface 410.

Figure 28:
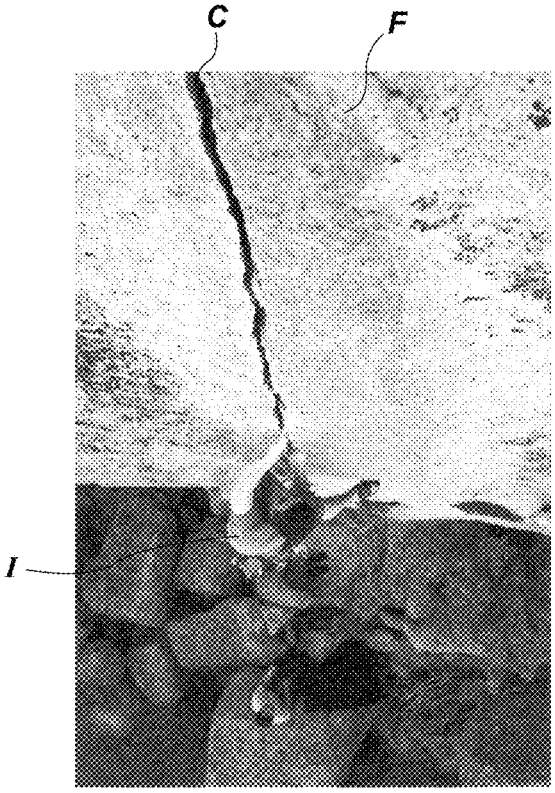
FIGS. 28 and 29 illustrate embodiments of methods for gathering data that enables the fabrication of a series of pods that simulate a natural crack in a rock formation.
Figure 29:
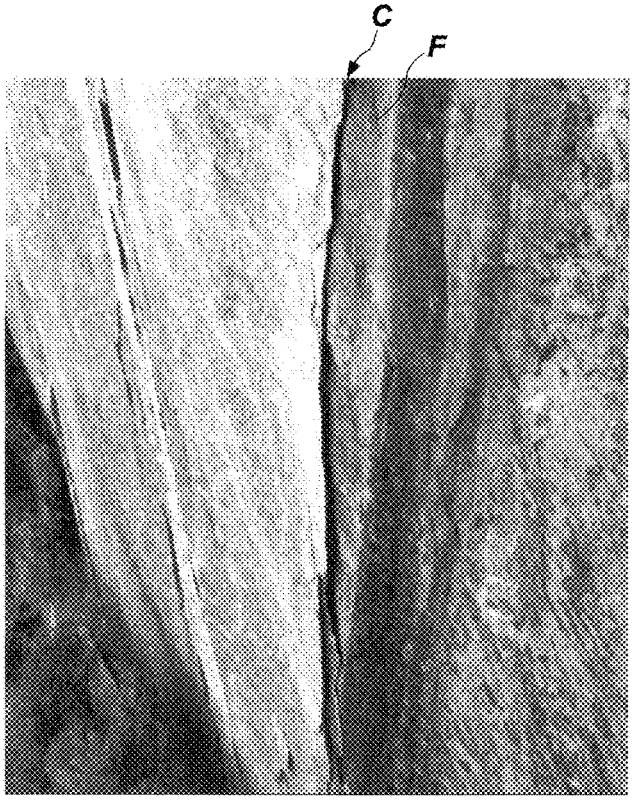

Turning now to FIGS. 28 and 29, a specific embodiment of a method for designing a crack that resembles a crack in a natural rock formation may include obtaining an image of a natural crack C (e.g., a world-famous crack, etc.). In a specific embodiment, an individual I, such as an experienced climber, carrying a camera (e.g., a three-dimensional scanning camera, etc.) may obtain images of the natural crack C as the individual I uses the natural crack C to ascend a face F of the natural rock formation, or as the individual I otherwise moves up or down along the face F, adjacent to the natural crack C. The camera may be used to capture the dimensions of the natural crack C, as well as information about texture of the natural crack C and features of the face F on each side of the natural crack C (e.g., to a resolution of about 0.2 mm or less; to a width of about 12 inches (about 30.5 cm); etc.).

The data obtained with the camera may then be processed in a manner known in the art. The data may be used to provide a file that can be used to control operation of automated manufacturing equipment of a type known in the art (e.g., a CNC machine, etc.). The automated manufacturing equipment can be used, for example, to fabricate a form, or a plug, from a blank (e.g., from a block of foam, etc.), from which a mold (e.g., a fiberglass mold, etc.) may be made. The mold may then be used to form one or more pods 50 (FIGS. 1, 2 and 7-12), 50' (FIGS. 18-20), 50" (FIGS. 21 and 22) that define a replica of the natural crack C.

In use, the pods 50, 50', 50" may be oriented on a climbing surface in a manner that simulates the orientation of the natural crack C in the face F of the natural rock formation, enabling individuals I to try their skill at climbing a replica of the natural crack C in a controlled, safe environment.

Although the foregoing description sets forth many specifics, these should not be construed as limiting the scope of any of the claims, but merely as providing illustrations of some embodiments and variations of elements or features of the disclosed subject matter. Other embodiments of the disclosed subject matter may be devised which do not depart from the spirit or scope of any of the claims. Features from different embodiments may be employed in combination. Accordingly, the scope of each claim is limited only by its plain language and the legal equivalents thereto.

What is claimed:

1. A crack climbing module, comprising:

a frame including:

a base with a plurality of mounts that enable the base to be secured to a climbing surface of a manufactured climbing wall;

side walls extending from the base;

a receptacle defined by the base and the side walls;

coupling decks extending outwardly in opposite directions from the side walls, the coupling decks being substantially coplanar with one another, each coupling deck including a series of couplers; and transitions extending outwardly from the coupling decks, the transitions extending toward a plane in which the base is located; and at least one pod including:

a body including a first side and a second side with opposed interior surfaces that define a crack, the body insertable into the receptacle of the frame; and coupling wings that extend outwardly from sides of the body, with configurations that enable the coupling wings to be at least partially superimposed over the coupling decks of the frame upon introduction of the body of the at least one pod into the receptacle of the frame, and including couplers that are arranged to align with corresponding couplers of the coupling decks.

2. The crack climbing module of claim 1, comprising a plurality of interchangeable pods that define cracks with different shapes.

3. The crack climbing module of claim 2, wherein each pod of the plurality of interchangeable pods includes a crack that simulates a crack of a natural rock climbing formation.

4. The crack climbing module of claim 1, wherein:

the at least one pod is adjustable to a plurality of widths, each width of the plurality of widths imparting the crack with a different width than every other width of the plurality of widths.

5. The crack climbing module of claim 4, wherein the receptacle and the coupling decks receive the at least one pod in the plurality of widths.

6. The crack climbing module of claim 1, wherein the plurality of mounts of the base of the frame enable the frame to be mounted to the climbing surface of the manufactured climbing wall with climbing hold bolts.

7. The crack climbing module of claim 1, wherein the couplers of the coupling decks of the frame and the couplers of the at least one pod enable the at least one pod to be secured to the frame with climbing hold bolts.

8. The crack climbing module of claim 4, further comprising:

a plurality of spacers positionable on the coupling decks of the frame, between outer edges of the coupling wings of the at least one pod and inner edges of the transitions of the frame.

9. A manufactured climbing structure, comprising:

at least one climbing surface;

at least one channel recessed in the at least one climbing surface;

a pair of coupling decks extending vertically along opposite sides of the at least one channel, recessed in the at least one climbing surface, and including couplers; and a series of pods at least partially within the at least one channel and secured to the pair of coupling decks, each pod including:

a body including a first side and a second side with opposed interior surfaces that define a crack that opens to opposite first and second ends of the body, a first end of the crack alignable with an end of a crack in a body of another pod of the series of pods positioned adjacent to the first end of the body of each pod to define a continuous crack, the body receivable by the at least one channel; and coupling wings that extend outwardly from sides of the body, with configurations that enable the coupling wings to be superimposed over the pair of coupling decks upon introduction of the body of each pod into the at least one channel such that outer surfaces of the coupling wings are substantially coplanar with the at least one climbing surface, the coupling wings including couplers that are arranged to align with corresponding couplers of the pair of coupling decks.

10. The manufactured climbing structure of claim 9, comprising at least one of a climbing wall, a climbing tower, and an artificial boulder.

11. The manufactured climbing structure of claim 9, comprising a plurality of interchangeable pods that define cracks with different shapes.

* * * * *